US006386162B2

(12) United States Patent
Himsel

(10) Patent No.: US 6,386,162 B2
(45) Date of Patent: May 14, 2002

(54) VARIABLE VALVE DRIVE FOR LOAD CONTROL OF A POSITIVE IGNITION INTERNAL COMBUSTION ENGINE

(75) Inventor: Frank Himsel, Neuhaus (DE)

(73) Assignee: Ina Walzlager Schaeffler OHG, Herzogenaurach (DE)

( * ) Notice: Subject to any disclaimer, the term of this patent is extended or adjusted under 35 U.S.C. 154(b) by 0 days.

(21) Appl. No.: 09/779,066

(22) Filed: Feb. 8, 2001

(51) Int. Cl.[7] ..... F01L 1/34
(52) U.S. Cl. ..... 123/90.16; 123/90.15
(58) Field of Search ..... 123/90.15, 90.16, 123/90.17, 90.39, 90.41, 90.42, 90.43, 90.44, 90.46

(56) References Cited

U.S. PATENT DOCUMENTS

| | | | | |
|---|---|---|---|---|
| 4,572,118 A | | 2/1986 | Baguena | |
| 4,714,057 A | * | 12/1987 | Wichart | 123/90.15 |
| 5,937,809 A | | 8/1999 | Pierik et al. | |
| 6,135,076 A | * | 10/2000 | Benlloch Martinez | 123/90.16 |

FOREIGN PATENT DOCUMENTS

| | | | |
|---|---|---|---|
| DE | 3833540 | A1 | 4/1990 |
| DE | 4242634 | A1 | 7/1993 |
| DE | 4313656 | A1 | 10/1994 |
| DE | 4308582 | C2 | 2/1997 |
| DE | 19629349 | A1 | 1/1998 |
| DE | 19640520 | A1 | 4/1998 |
| DE | 19904840 | A1 | 8/2000 |
| FR | 2472078 | | 6/1981 |

* cited by examiner

*Primary Examiner*—Thomas Denion
*Assistant Examiner*—Jaime Corrigan
(74) *Attorney, Agent, or Firm*—Volpe and Koenig, P.C.

(57) ABSTRACT

A fully variable valve drive (10) for throttle-free load control of an internal combustion engine is proposed. It is particularly characteristic of the invention, that a transmission component (4) is provided for a valve activation component (13) that is produced with two distinguishable parts. The one includes a lever (4*a*) that communicates at one end with a cam (2), and on the other hand of a catch (4*b*). This catch (4*b*) is attached at an end (5) of the lever (4*a*) that is away from the cam (2) in a manner that allows for pivotable movement. The catch (4*b*) communicates with a contact range (15) of a rotatable adjustment mechanism (9) on the one hand. On the other hand, it works on the valve activation component (13) through a swing movement. This can be influenced by assignment of the location of the rest range (15) with reference to a target (12) of the handle (4*b*).

12 Claims, 1 Drawing Sheet

VARIABLE VALVE DRIVE FOR LOAD CONTROL OF A POSITIVE IGNITION INTERNAL COMBUSTION ENGINE

BACKGROUND

The invention involves a variable valve drive for controlling the load of a positive ignition internal combustion engine. Moreover, the invention preferably involves a fully variable valve drive, which can effectuate a throttle-free load control for the internal combustion engine. Furthermore, this valve drive is installed in a position between one cam of a camshaft and at least one intake valve, where the intake valve adjoins immediately with a valve activation component, with a component designed for transmission, and with an adjustment mechanism designed to exert an influence on the lifting function of the transmission component. In addition, this transmission component—in a drive-like fashion—is built into position between the cam and the valve activation component, and has a first working surface that is opened up by the cam, as well as a second working surface that acts upon the valve activation component.

The advantages of throttle-free load control, over the sort of load control involving fully variable valve drives, are generally known to those skilled in the art. Through such "de-throttlization," one succeeds in putting a stop to the losses that would otherwise come about due to suction—over a wide range of load conditions of the internal combustion engine.

Thus, DE 195 09 604 A1 discloses a fully variable finger lever drive, whose transmission component, formed as a further finger lever, can be adjusted from a point off center. The transmission component is opened by torsion leg spring which acts as a lost-motion spring.

Referring to this previously known valve drive it is disadvantageous for it to be built to undesirably high levels, as a result of the upright orientation of its transmission component, with the off-center point lying above. In exactly this cylinder head area, as a general rule, there is hardly any building space still in existence for the accommodation of the aforementioned building components. Consequently, in the event of the worst case scenario, costly modifications would have to be made in the area of the cylinder head cover, extending even into the area of the motor. It is further to be established that, in the process of being opened up and adjusted, the lever goes through a very complex course of movement, that is to be controlled only with great difficulty on the basis of intricate interpretation of a highly technical and mathematical nature.

Very often, with the fully variable systems described in the literature, the point in time at which the intake is shut off is also merely altered, with the simultaneous possibility of variation of a lift of the opened gas exchange valve.

SUMMARY

The object of the invention, therefore, is to create a valve drive of the aforementioned type, in connection with which the above-cited disadvantages have been eliminated.

In accordance with the invention, this task is accomplished by the fact that the transmission component is produced in such a way that it possesses two parts, and by the fact that it has one lever with the first working surface, and at least one catch with the second working surface, which catch is attached to the lever, at an end of the lever facing the valve activation component, by a pivot center, as well as adjoins with its second working surface at a contact surface of the valve activation component, whereby each catch has a third working surface for the respective adjustment mechanism, that extends on a side that faces away from the second working surface, which third working surface acts on a contact range of the adjustment mechanism during cam lifting, whose lifting is extended in the direction of the opening of the intake, and in connection with which the contact range is movable relative to the third working surface.

By these means, a valve drive is created—preferably of the fully variable type—that has a clearly lower height of construction as compared with the valve drive that was referred to in the introductory portion of the description. It is to be established, moreover, that it can be more simply constructed, with a clearly simplified course of movement, with adjustment and cam lifting. Consequently, the height of construction in the cylinder head area is either not increased at all, or—if increased—only to a minimal extent, so that costly modifications are not necessary in the construction components surrounding the interior combustion engine.

The fact that—through the way in which the contact range is installed on the adjustment mechanism—this contact range is not moved with the valve lifting constitutes a significant difference from the type forming the current state of the art. The contact range moreover is situated in a completely advantageous manner inside of, as well as underneath, a construction area that is canopied by the lever on the side of the valve. In this manner, a valve drive is created that is highly compact in its mode of construction.

Through the solution proposed by this invention, the duration of the opening of at least one opened up intake valve is amenable to being adjusted in a stepless fashion, and the height of the valve lifting is similarly susceptible to such stepless adjustment. Moreover, with respect to some further systems described in the current state of technology, it is advantageously the case, that even the time period for the opening of the intake can be retarded. In this context, it is suggested that the camshaft be equipped, in a familiar mode of construction, with a device for its relative rotation. In this manner, a backward adjustment that might perhaps be desired in the "early" direction can also be realized.

In a pivoting movement of the lever in the opening direction of the intake valve, the catch that is positioned for pivoting movement at the one end of the lever travels through a motion channel lying between a contact surface of the valve activation component and a contact range of the adjustment mechanism. In the motion channel, the catch can be forcibly shifted as to its position, as a function of a pivoting movement of the adjustment mechanism in the direction of the opening of the intake valve. This forcible pivoting movement in the aforesaid opening direction, consequently, results in the fully variable opening movement of the intake valve. In the zero lifting section, the catch merely rotates around the pivot center of the lever.

It is especially advantageous, in accordance with the invention, when for reasons of symmetry, one catch is installed on each of the two sides of the lever. Each of these catches then works with at least one gas exchange valve indirectly over each one of the finger levers. In a further development of this embodiment, the contact ranges of the two catches can be endowed with different lifting characteristics. This design can be utilized for the formation of a mixture-forming spin effect in the combustion chamber.

In an advantageous manner, the adjustment mechanism is adjoined directly to the lever and proceeds in a further advanced development of the invention, in accordance with which, the lever is formed as a rocker arm on the axis. It is also conceivable, however, that the adjustment mechanism might be formed as a construction component that is entirely removed and separated from the lever, which construction component can also have geometrical proportions that deviate from the finger form. It is only important that the adjustment mechanism should produce an adjustable pivoting movement for the catch in the direction of the opening of the intake valve.

In an advantageous manner, the zero lifting section of the contact range of the adjustment mechanism is formed with a sufficient length, that by the corresponding positioning of the catch to this area, either a zero lifting, or only a minimal lifting is produced at the intake valve. Consequently, the entire system can also be utilized for purposes of shutting off the valve, as well as for cylinder shut-off.

A highest valve lifting is produced at the intake valve, when the adjustment mechanism is rotated with reference to the third working surface of the catch, in a manner such that the third working surface—by cam lifting—travels through a maximum increase of the contact range of the adjustment mechanism. At the most remote point, this maximum increase lies at the beginning of the zero lifting section, which beginning is located on the side of the lever. An adjustment can be effectuated during the entire course of a cam run.

In the event that this becomes necessary, the lever can be withdrawn entirely with the opening up of the cam. It is only important in this case that the catch should experience the forced spatial movement, within the motion channel, for example, through a crank drive, or the like.

It is, moreover, a preferred feature of the invention, that the valve activation component can be produced as a finger lever. With that which is implied by the scope of protection of the invention there are also valve activation components, that, for example, may be produced as either finger levers or rocker arms, but also as a tappet. Furthermore, the variable valve drive that has been suggested can also be applied in the case of a tappet drive.

In order to achieve a permanent position of the lever at the cam, the lever is acted on by means of a lost-motion element, such as a helical spring in the direction of the cam. This spring mechanism can also be installed in an advantageous manner in the construction space that is canopied by the lever on the side on which the valve is located. In addition, it is particularly advantageous that the length of this spring is not concomitantly adjusted in conformity with the lifting adjustment, contrary to what was said of the current state of technology as referenced in the introductory portion of this description. In that case, an undesirable relaxation of this spring is brought about, in the direction of a smaller lifting, as a result of an associated adjustment.

BRIEF DESCRIPTION OF THE DRAWINGS

The invention is explained in greater detail on the basis of the drawings, in which.

DETAILED DESCRIPTION OF THE PREFERRED EMBODIMENT

Figure 1:
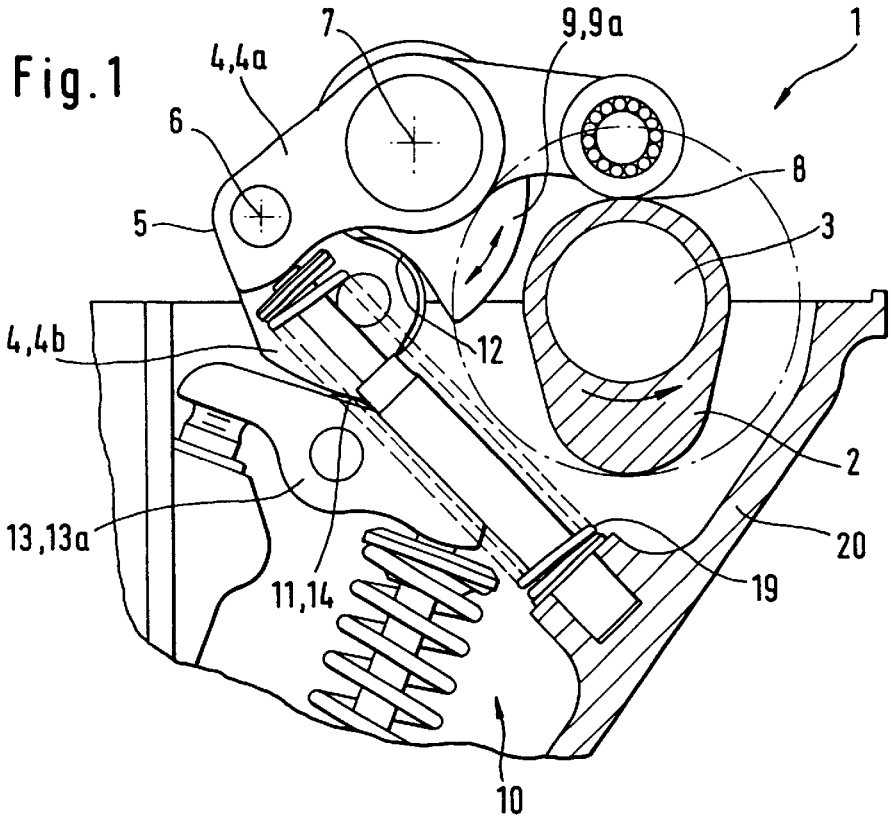
FIG. 1 is a longitudinal cross-section through the valve drive in accordance with the invention, in the area of the cam and lever.

FIG. 1 shows a variable valve drive (1). This is used for purposes of load control for a positive ignition internal combustion engine, and it is formed preferably in a fully variable fashion. The valve drive (1) includes a cam (2) of a cam shaft (3). In this instance, the cam (2) is represented in its base circle contact with a transmission component (4), in accordance with FIGS. 1 and 2. The transmission component (4) is formed as an assembly having two distinct parts, and includes a lever (4*a*) and a catch (4*b*). The catch (4*b*) is attached to an end (5) of the lever (4*a*) on a pivot center (6). As already pointed out in the statements setting forth the advantages relating to the invention, it is advantageous to install on catch (4*b*) on both sides of the lever (4*a*), which indirectly works with each one of the finger levers (13*a*).

The lever (4*a*) is produced here as a rocker arm, that is positioned in place about a pivot center (7), upon an axis that is to be explained more fully below. It has a first working surface (8). This is produced here as a roller, for purposes of contact with the cam (2), and it is positioned in such a way as to allow for rotation. In a similar way, an adjustment mechanism (9)—that will been explained later in this description—is located on the pivot center (7) of the lever (4*a*) in such a way as to be capable of pivoting movement. This adjustment mechanism is formed here as rotatory fingers (9*a*), and it extends in the direction of a construction space (10) that is canopied by the lever (4*a*).

The catch (4*b*) extends approximately perpendicular to the lever (4*a*). It has a second working surface (11), opposite to which lies a third working surface (12) which faces toward the lever (4*a*). The second working surface ( 11) forms part of a cylinder surface that is envisioned around the pivot center (7). It acts upon a contact surface (14) of a valve activation component (13), that is produced here as a finger lever (13*a*). This contact surface (14) which is not represented here in a more detailed manner is shown as a roller. In a similar manner, the third working surface (12) of the catch (4*b*) is produced as a roller.

Figure 2:
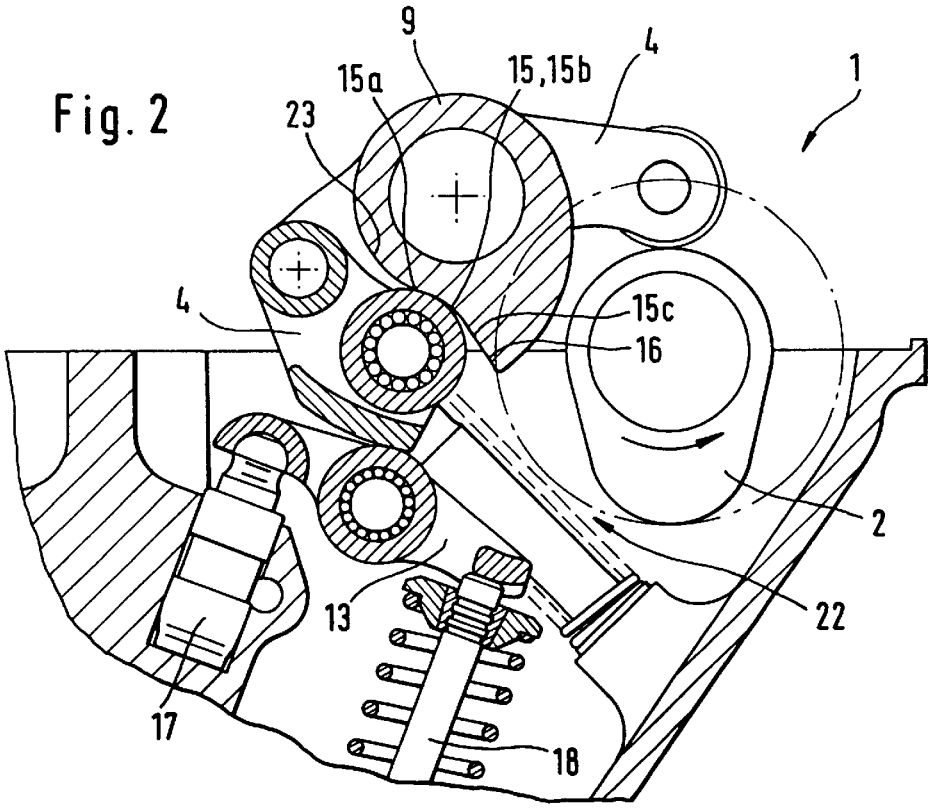
FIG. 2 is a similar cross-section cut, taken through the catch.

On the side facing the third working surface (12), the adjustment mechanism (9) has a contact range (15) (see also FIG. 2). This constant range consists of a zero lifting section (15*a*) that is located on the lever side, an acceleration flank (15*b*) that extends in the direction of the lever, and a following lift area (15*c*) with a maximum lift (16).

It is to be mentioned that the finger lever (13*a*) on one of it ends is positioned on a preferably hydraulically formed support element (17), and that on its other side it acts on one or several intake valves (18).

Moreover, the expert can determine from the figures, that the lever (4*a*) is biased in direction of the cam (2)—by means of a spring mechanism (19)—that is formed here as a helical spring. This acts on the end (5) of the lever (4*a*) at one end, and is supported at the other end on a cylinder head (20) of the internal combustion engine.

With the forced pivoting movement of the lever (4*a*) with the catch (4*b*), that is effectuated by means of the cam (2), a movement is enforced for the catch (4*b*) within motion channel (22) that lies between the contact surface (14) and the contact range (15). In conformity with the pivoting of the adjustment mechanism (9), which is shown in the Figures, a maximum lifting is produced with reference to the third working surface (12) at the intake valve (18). In order to achieve this outcome, the third working surface (12) of the catch (4*b*) must stand at the beginning of the acceleration flank (15*b*), in the base circle of the cam (2). With further swing movement of the lever (4*a*), the third working surface (12) goes through the remainder of the contact range (15) up to the point of its maximum increase (16). In this manner, a maximum pivoting movement in the direction of the opening of the intake valve (18) is forced upon the catch (4*b*). Ultimately, a complete opening is effectuated. Consequently, a pivoting movement is imposed upon the catch (4*b*), that results in a pivoting about the pivot axis (7), and a rotation around the pivot center (6).

If, for example, a zero lifting of the intake valve (18) is desired, in that case the adjustment mechanism (9) is pivoted by an activation mechanism (which is not described in any further detail here) in a counter clockwise direction, so that the third working surface (12) lies at a beginning (23) of the cylindrical zero lifting section (15*a*). This beginning (23) is the most remotely situated relative to the maximum increase (16). By means of the interpretation of the length of the cylindrical zero lifting section (15*a*) that is sent out, the third working surface (12) traverses through the entire zero lifting section (15*a*), at the time of cam lifting. The catch (4*b*) executes only a rotation around the pivot center (7) in a counter clockwise direction. Consequently, the intake valve (18) remains closed.

Also, all types of adjustments lying between the previously described possible points of adjustment are of course possible.

LIST OF REFERENCE NUMBERS

| | |
|---|---|
| 1 Valve Drive | 13a Drag Lever |
| 2 Cam | 14 Contact Surface |
| 3 Cam shaft | 15 Contact Range |
| 4 Transmission Component | 15a Zero Lifting Steps |
| 4a Rocker arm | 15b Acceleration Flank |
| 4b Catch | 15c Lift Limit |
| 5 End | 16 Maximum Increase |
| 6 Pivot Center | 17 Support Element |
| 7 Pivot Center | 18 Intake Valve |
| 8 First Working Surface | 19 Spring Mechanism |
| 9 Adjustment Mechanism | 20 Cylinder Head |
| 9a Rotating Fingers | 21 Not Allocated |
| 10 Construction Space | 22 Motion Channel |
| 11 Second Working Surface | 23 Beginning |
| 12 Third Working Surface | |
| 13 Valve Activation Component | |

What is claimed is:

1. Variable valve drive (1) for load control of a positive ignition internal combustion engine, that is located between a cam (2) of a cam shaft (3) and at least one intake valve (18), comprising a valve activation component (13), a transmission component (4), and an adjustment mechanism (9) that exerts an influence on a lifting function of the transmission component (4), the transmission component (4) acts between the cam (2) and the valve activation component (13), and has a first working surface (8) that is acted upon by the cam (2), and a second working surface (8, 11) that acts on the valve activation component (13), the transmission component (4) includes a lever (4*a*) with the first working surface (8) and at least one catch (4*b*) with the second working surface (11), the catch (4*b*) is pivotably attached on an end (5) of the lever (4*a*) facing the valve activation component (13) about a pivot center (6) on the lever (4*a*), the second working surface (11) acts on a contact surface (14) of the valve activation component (13), the catch (4*b*) includes a third working surface (12) that contacts a respective adjustment mechanism (9), the third working surface is located on a side opposite to the second working surface (11), the third working surface (12) engages a contact range (15) on the adjustment mechanism (9) having a rise that extends in a direction of opening of the intake valve (18), and the contact range (15) is movable in relation to the third working surface (12).

2. Valve drive in accordance with claim 1, wherein the adjustment mechanism (9) comprises rotatory fingers (9*a*) having a side facing the third working surface (12) upon which the contact range (15) is formed, a movement channel (22) is located between the contact range (15) and the contact surface (14) for movement of the catch (4*b*) during cam lifting.

3. Valve drive in accordance with claim 2, wherein the contact range (15) includes a zero lifting section (15*a*), an acceleration flank (15*b*) that follows in a direction of movement of the catch (4*b*) at a time of cam lifting, and a lifting area (15*c*) that follows therefrom.

4. Valve drive in accordance with claim 3, wherein the zero lifting section (15*a*) is formed in a cylindrical form, and has a sufficient length and can be positioned such that the catch (4*b*) does not experience any pivoting movement in the direction of opening of the intake valve (18), at the time of traversing through the motion channel (22).

5. Valve drive in accordance with claim 3, wherein the lifting area (15*c*) includes a maximum lift (16) in an area remote from the lever (4*a*) that can be positioned through the adjustment mechanism opposite to the third working surface (12) such that there is generated a maximum pivot movement in the direction of the opening of the intake valve (18) at the catch (4*b*) upon is generated upon cam lifting forced movement through the motion channel (22).

6. Valve drive in accordance with claim 2, wherein the lever (4*a*) is formed as a rocker arm having a pivot center (7) on an axis that forms the axis for the adjustment mechanism (9).

7. Valve drive in accordance with claim 6, wherein the lever (4*a*) is acted upon by a spring in a direction toward the cam (2) by a spring mechanism (19), which acts on the end (5) that faces the valve activation component (13) at one end, and on the other end, is supported opposite a cylinder head (20) of the internal combustion engine and lies in a construction space (10) that is canopied by the lever (4*a*), on a cam side of the valve.

8. Valve drive in accordance with claim 1, wherein at least one of the first working surface (8), the second working surface (11), the third working surface (12), or the contact surface (14) is formed as a roller that is positioned for rotation.

9. Valve drive in accordance with claim 1, wherein the valve activation component (13) is produced as a finger lever (13*a*).

10. Valve drive in accordance with claim 1, wherein the lever (4*a*) is acted upon biased in a direction toward the cam (2) by a spring mechanism (19), which acts on the end (5) that faces the valve activation component (13) at one end, and on the other end, is supported opposite a cylinder head (20) of the internal combustion engine and lies in a construction space (10) that is canopied by the lever (4*a*) on a cam side of the valve.

11. Valve drive in accordance with claim 1, wherein the cam shaft (3) is equipped with a device for the relative rotation in connection with a drive wheel that drives the cam shaft.

12. Valve drive in accordance with claim 1, wherein two catches (4*b*) are connected to each of the levers (4*a*), and each catch acts on one of the valve activation components (13).

* * * * *